US006865817B2

(12) United States Patent
Militello et al.

(10) Patent No.: US 6,865,817 B2
(45) Date of Patent: Mar. 15, 2005

(54) WINDOW SHADE WITH MEASUREMENT GUIDE

(75) Inventors: David R. Militello, Rohnert Park, CA (US); Barry L. Shevick, Fair Oaks, CA (US)

(73) Assignee: Shades Unlimited, Inc., Cotati, CA (US)

( * ) Notice: Subject to any disclaimer, the term of this patent is extended or adjusted under 35 U.S.C. 154(b) by 0 days.

(21) Appl. No.: 10/402,452

(22) Filed: Mar. 27, 2003

(65) Prior Publication Data

US 2004/0187325 A1 Sep. 30, 2004

(51) Int. Cl.[7] ..... E06B 3/00

(52) U.S. Cl. ..... 33/194; 33/758; 160/84.07; 83/452; 83/762

(58) Field of Search ..... 33/194, 485–488, 33/759–760, 768, 770; 160/84.07, 134; 83/452, 454, 465, 761–762, 466.1

(56) References Cited

U.S. PATENT DOCUMENTS

| | | | | | |
|---|---|---|---|---|---|
| 2,134,332 | A | * | 10/1938 | Hubbard | 83/762 |
| 2,187,087 | A | * | 1/1940 | Leary | 33/758 |
| 2,932,897 | A | * | 4/1960 | Huber | 33/758 |
| 3,760,664 | A | | 9/1973 | Gossling | |
| 3,782,235 | A | * | 1/1974 | Curcio | 83/762 |
| 3,936,944 | A | * | 2/1976 | Byne | 33/758 |
| 4,102,385 | A | | 7/1978 | Miller | |
| 4,139,941 | A | * | 2/1979 | Meacham | 30/123 |
| 4,271,893 | A | | 6/1981 | McCluskey | |
| 4,403,415 | A | | 9/1983 | Kufrin | |
| 4,539,238 | A | | 9/1985 | Markowitz | |
| 4,539,239 | A | | 9/1985 | Graves | |
| 4,589,313 | A | | 5/1986 | Meyers | |
| 4,597,430 | A | | 7/1986 | Marquez | |
| 4,711,005 | A | | 12/1987 | Chang | |

(List continued on next page.)

OTHER PUBLICATIONS

Peel 'N Stick Vinyl Temp Shade; Temp Shade, 2455 Paces Perry Road, N.W., Atlanta, GA 30339; Made in China.

*Primary Examiner*—Christopher W. Fulton
*Assistant Examiner*—Tania Courson
(74) *Attorney, Agent, or Firm*—Heisler & Associates

(57) ABSTRACT

A system is provided for properly resizing a window shade to fit within a window frame adjacent a window. At least one ruler strip is provided with visible graduations thereon. Indicia are provided adjacent at least some of the graduations. The indicia are descriptive of a width of a window frame in which the window shade will fit when the window shade is cut at the graduation adjacent to that indicia. A position of the graduations and the corresponding indicia are misdescriptive of a width of the window shade so that clearance around the perimeter of the window shade and cutting of both edges of the window shade are accommodated. Both rectangular window shade and arched window shade sizing systems are provided. A retainer is also provided for holding and guiding of a cutting tool during cutting of the window shade for proper resizing.

42 Claims, 5 Drawing Sheets

U.S. PATENT DOCUMENTS 4,712,457 A 12/1987 Percivalle
4,758,042 A 7/1988 Liu
4,776,096 A 10/1988 Chang
4,819,530 A 4/1989 Huang
4,836,265 A 6/1989 Bussert
4,907,325 A 3/1990 Hsu
4,993,131 A 2/1991 Graves
5,010,939 A * 4/1991 King ..... 160/84.07
5,025,848 A 6/1991 Prochaska
5,056,388 A 10/1991 Dekker
5,072,494 A 12/1991 Graves
5,158,127 A 10/1992 Schumacher
5,279,473 A 1/1994 Rozon
5,339,716 A 8/1994 Sands
5,354,011 A 10/1994 Rozon
5,456,149 A 10/1995 Elsenheimer
5,799,557 A 9/1998 Wang
5,813,306 A * 9/1998 Jacoff ..... 83/762
5,816,126 A 10/1998 Pluber
5,915,442 A 6/1999 Prosch
5,927,172 A 7/1999 Wang
6,003,217 A 12/1999 Graves
6,024,154 A 2/2000 Wang
6,029,553 A 2/2000 Berntsson
6,029,734 A 2/2000 Wang
6,039,103 A 3/2000 Huang
6,089,134 A 7/2000 Marocco
6,098,694 A 8/2000 Ohanesian
6,149,094 A 11/2000 Martin
6,171,424 B1 1/2001 Barss
6,178,857 B1 1/2001 Marocco
6,240,824 B1 6/2001 Hsu
6,257,301 B1 * 7/2001 Conforti ..... 160/84.07
6,283,192 B1 9/2001 Toti
6,289,965 B1 9/2001 Ruggles
6,314,851 B1 11/2001 Graves
6,330,899 B1 12/2001 Ciuca
6,334,379 B1 1/2002 Sudano
6,336,388 B1 1/2002 Marocco
6,412,381 B1 7/2002 Wang
6,427,571 B1 8/2002 Hsu
6,435,066 B1 8/2002 Kutchmarek et al.
6,508,293 B1 1/2003 Huang
6,560,849 B1 5/2003 Modra
6,571,853 B1 6/2003 Ciuca
6,575,223 B1 6/2003 Chung
6,601,635 B2 8/2003 Ciuca
6,637,124 B2 * 10/2003 Pederson ..... 33/758
2001/0017073 A1 8/2001 Marocco
2003/0033919 A1 2/2002 Lin
2002/0033241 A1 3/2002 Palmer
2002/0062723 A1 5/2002 Marocco
2002/0088562 A1 7/2002 Palmer
2002/0148134 A1 * 10/2002 Meyer et al. ..... 33/758
2002/0157796 A1 10/2002 Judkins
2002/0178884 A1 12/2002 Chuang
2003/0015074 A1 1/2003 Roberts
2003/0070515 A1 4/2003 Huang
2003/0085002 A1 5/2003 Palmer
2003/0111191 A1 6/2003 Ciuca

* cited by examiner

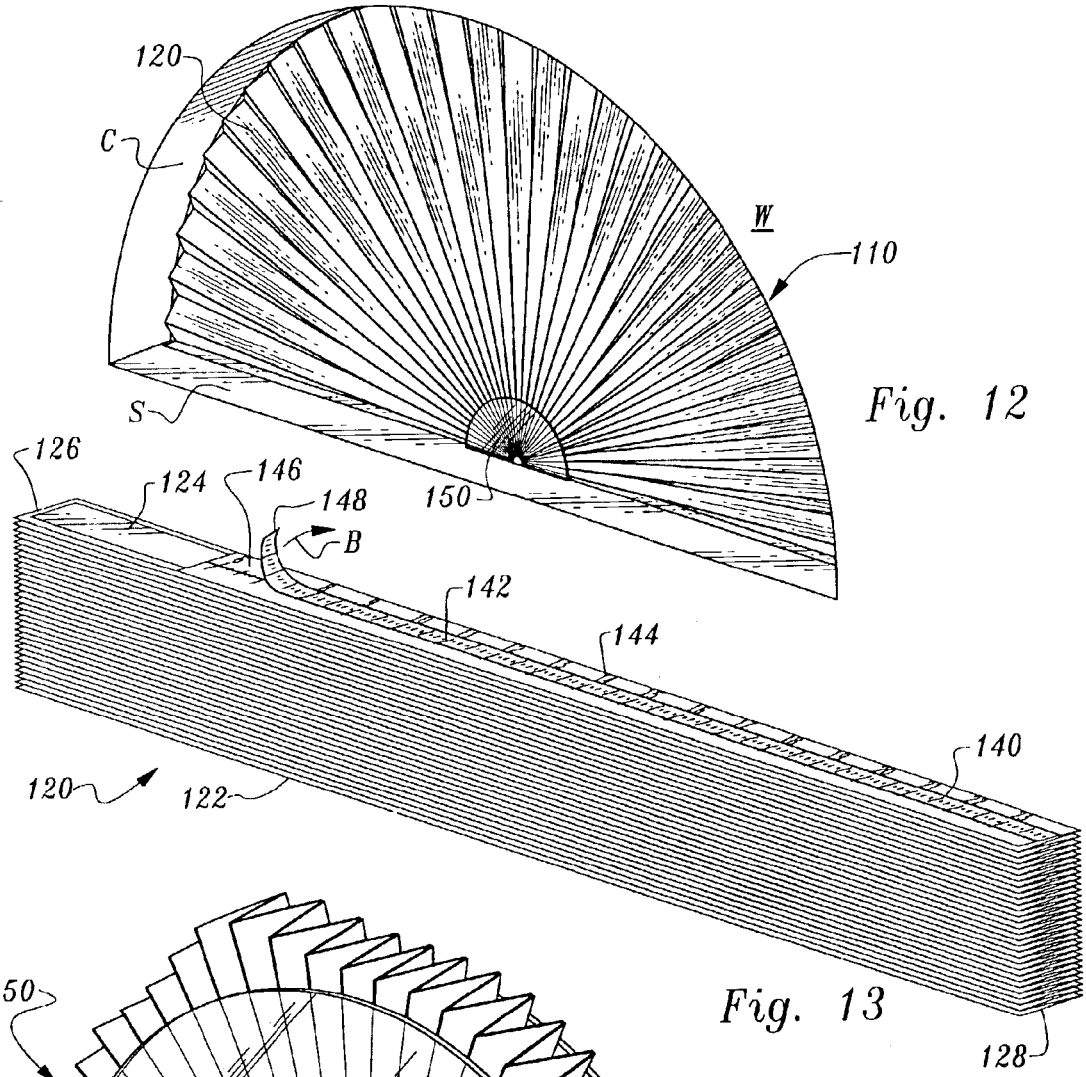
Fig. 12
Fig. 13
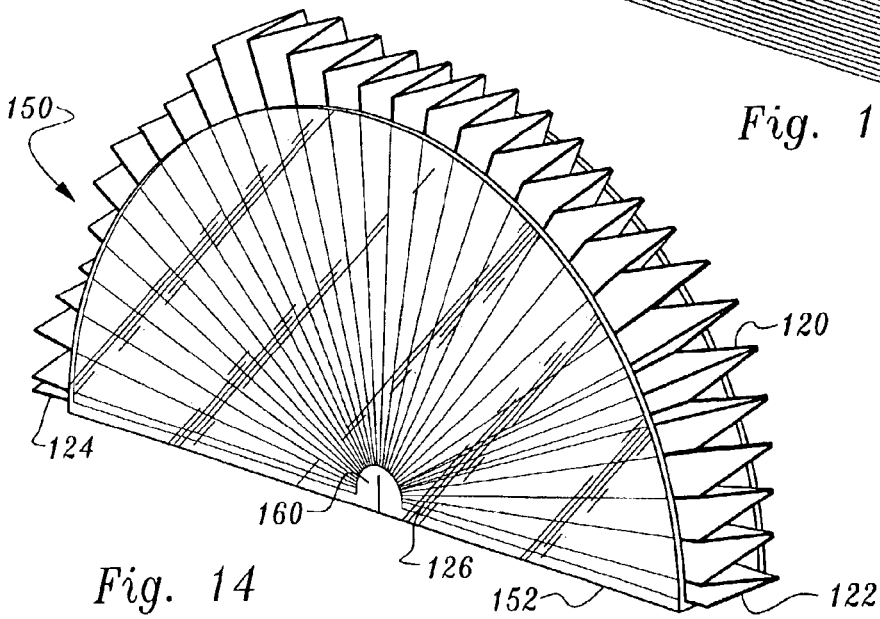
Fig. 14

WINDOW SHADE WITH MEASUREMENT GUIDE

CROSS-REFERENCE TO RELATED APPLICATIONS

This application incorporates by reference the entire contents of U.S. Pat. No. 5,158,127 and U.S. patent application Ser. Nos. 10/194,193 and 10/318,975.

FIELD OF THE INVENTION

The following invention relates to window shades and window blinds for occluding at least a portion of a space adjacent a window and to guides for appropriately measuring and cutting such shades or blinds to fit within a space adjacent the window. More particularly, this invention relates to guides which simplify the measurement and cutting of rectangular and arched window shades or blinds in a simple and precise fashion.

BACKGROUND OF THE INVENTION

Windows come in a variety of shapes and sizes. It is often desirable to have a window shade (referring generally to either a shade or blind type structure) adjacent the window to at least partially occlude the passage of light through the window. Variations in size and shape of windows create a challenge in providing shades which properly fit such windows.

Prior art shades are known which are of a standard initial width and which are formed of a material which can be readily cut to exhibit an appropriate width. However, numerous difficulties are presented in properly executing this resizing procedure according to the prior art. First, windows are typically surrounded by frames and it is desirable to place the shade or blind within this frame. For the shade or blind to function properly, some amount of clearance is desirable along edges of the shade. Additionally, many shades include cords extending vertically at various locations within the shade. To maintain a distance of these cords spaced a similar distance away from edges of the shade, it is necessary that equal portions be cut from either both left and right edges of the shade.

Hence, a user must initially measure the window frame, then measure the standard width of the blind to determine how much should be cut. This amount to be cut away must then be divided in half so that an appropriate half amount can be cut away from either side. Finally, a clearance amount must be added to this final half measurement.

Then, once this total amount to be cut away from each edge has been calculated, the user must properly locate a cutting tool spaced from a left edge of the window shade and securely hold the shade while cutting through the shade. This cutting step must then be repeated for the right edge of the shade. When numerous windows are to be covered with shades, such as is the case in a typical residential home, this multi-step process must be repeated for each window to be covered within the home.

Accordingly, a need exists for a system for measuring and cutting window shades which can more easily, effectively and precisely allow the window shade to be measured and cut where required to allow the window shade to properly function adjacent a window. This need exists both for standard rectangular windows as well as for arched windows, such as those covered with shades as described in U.S. patent application Ser. No. 10/318,975, incorporated herein by reference.

SUMMARY OF THE INVENTION

This invention provides a ruler, in the form of strips or other structures for use adjacent a window shade, or printed or otherwise applied to the shade, to simplify the process of properly measuring and cutting a window shade for proper fit within a window frame adjacent a window. The ruler includes graduations thereon, typically in the form of linear lines, extending perpendicular to a long axis of the window shade. Indicia are placed adjacent at least some of the graduations. The indicia are typically in the form of numbers and these numbers correspond with a measurement of the width of the window frame in which the window shade is to be placed. For instance, the numbers making up the indicia can be representative of a number of inches (or a number of centimeters) representing a width of the window frame.

In a preferred form of this invention each indicium is representative of the width of the window frame and not representative of the width of the window shade, when the shade is cut at the graduation adjacent the indicium. The indicia are not precisely representative of any distance that the indicia are located away from either the left or right edges of the window shade. Rather, the indicia are misdescriptive of the actual width of the window shade and rather descriptive of the width of the window frame or other space in which the window shade is to be placed. In this way, appropriate clearance at edges of the window shade is automatically accounted for by the indicia. Hence, while the graduations and indicia bear close similarity to the markings on a standard prior art ruler (i.e. a yardstick or measuring tape), they are in fact distinct from such prior art measuring devices.

Additionally, according to a preferred embodiment of this invention, especially when a rectangular window shade is to be utilized to fill a rectangular or square window frame space, two ruler strips are provided, one adjacent the left edge of the window shade and the other adjacent the right edge of the window shade. The two ruler strips are similar to each other. In this embodiment, the indicia are located adjacent graduations which are actually twice as close to each other as would be the case with a standard ruler or measurement tape. For instance, the "25" indicia would be one half inch (or other unit of measure) away from the "26" indicia, rather than a one inch spacing on a prior art ruler.

Each pair of identical indicia on each of the two ruler strips adjacent the left edge or the right edge of the window shade are spaced a common distance away from either the left edge or the right edge. The indicia pairs are positioned adjacent graduations such that when each left and right edge of the window shade is cut at the graduations adjacent the same indicia representative of the entire width of the window frame, the window shade that results fits within the window frame with the proper amount of clearance. A symmetrical amount is taken from both the left edge and the right edge of the window shade to maintain a symmetrical appearance of the window shade, particularly when vertical cords or other patterns on the window shade make such symmetrical cutting of the window shade desirable.

A retainer is provided for securely holding the window shade in a fully collapsed configuration during cutting. The retainer preferably has an at least partially clear cap positionable adjacent a top of the window shade when the ruler is located adjacent a top of the window shade. The retainer also preferably includes a slit extending at least partially in a vertical plane perpendicular to a long axis of the window shade. The retainer is configured to slide along the long axis of the window shade. Hence, the retainer can be located adjacent the graduation which is adjacent the indicia representative of the width of the window frame. A cutting tool such as a knife can then be located within the slit and utilized to cut the window shade precisely through the proper graduation, with the resulting window shade having the width and desired clearance to fit within the window frame.

When an arched window shade is to be measured and cut, a rule analogous to the ruler described above can be utilized. With an arched window shade, either similar amounts can be removed from each edge of the arched shade, including the inside edge and the outside edge, or all material can be removed from a single edge. Such a single cut procedure could similarly be performed on a rectangular window shade having a non-symmetrical character.

When all material of the arched shade is to be removed from the same edge, a rule is provided with graduations and indicia representative of a height of the arched window plane above a sill. The rule does not accurately identify the width of the arched shade with the indicia. Rather, the indicia represent the height of the arched window and accounts for clearance desirable to allow the arched shade to be properly placed adjacent an arched window, particularly accounting for a gap at the inside edge and a clearance at the outside edge, adjacent a curved ceiling of the arched window frame.

OBJECTS OF THE INVENTION

Accordingly, a primary object of the present invention is to provide a window shade measuring and cutting system which simplifies the process of measuring and cutting a window shade to fit within a window frame adjacent a rectangular or arched window.

Another object of the present invention is to provide a system for simplifying the measurement of a window shade prior to cutting the window shade to properly fit within a window frame.

Another object of the present invention is to provide a window shade measurement system which allows equal amounts to be removed from both left and right edges of a window shade without requiring excessive measurements or calculations to be made.

Another object of the present invention is to provide a window shade sizing system which includes a retainer to both hold the window shade and guide a cutting tool where needed to cut excess portions of the window shade away.

Another object of the present invention is to provide a window shade with measurement guide that automatically accounts for a desired amount of clearance from surrounding edges of a window shade during resizing of a window shade to fit within a window frame.

Other further objects of the present invention will become apparent from a careful reading of the included drawing figures, the claims and detailed description of the invention.

BRIEF DESCRIPTION OF THE DRAWINGS

FIG. 12 is a perspective view of an arched window with an arched shade having been cut to appropriate size for placement adjacent the arched window.

FIG. 13 is a perspective view of the arched shade before having been fanned into a semi-circular form and showing the rule thereon for proper measurement of the arched shade, before installation of the arched shade along with a retainer adjacent the arched window.

FIG. 14 is a perspective view of a detail of a retainer for use in supporting the arched shade in a fanned configuration.

DESCRIPTION OF THE PREFERRED EMBODIMENT

Figures 1, 2, 3:
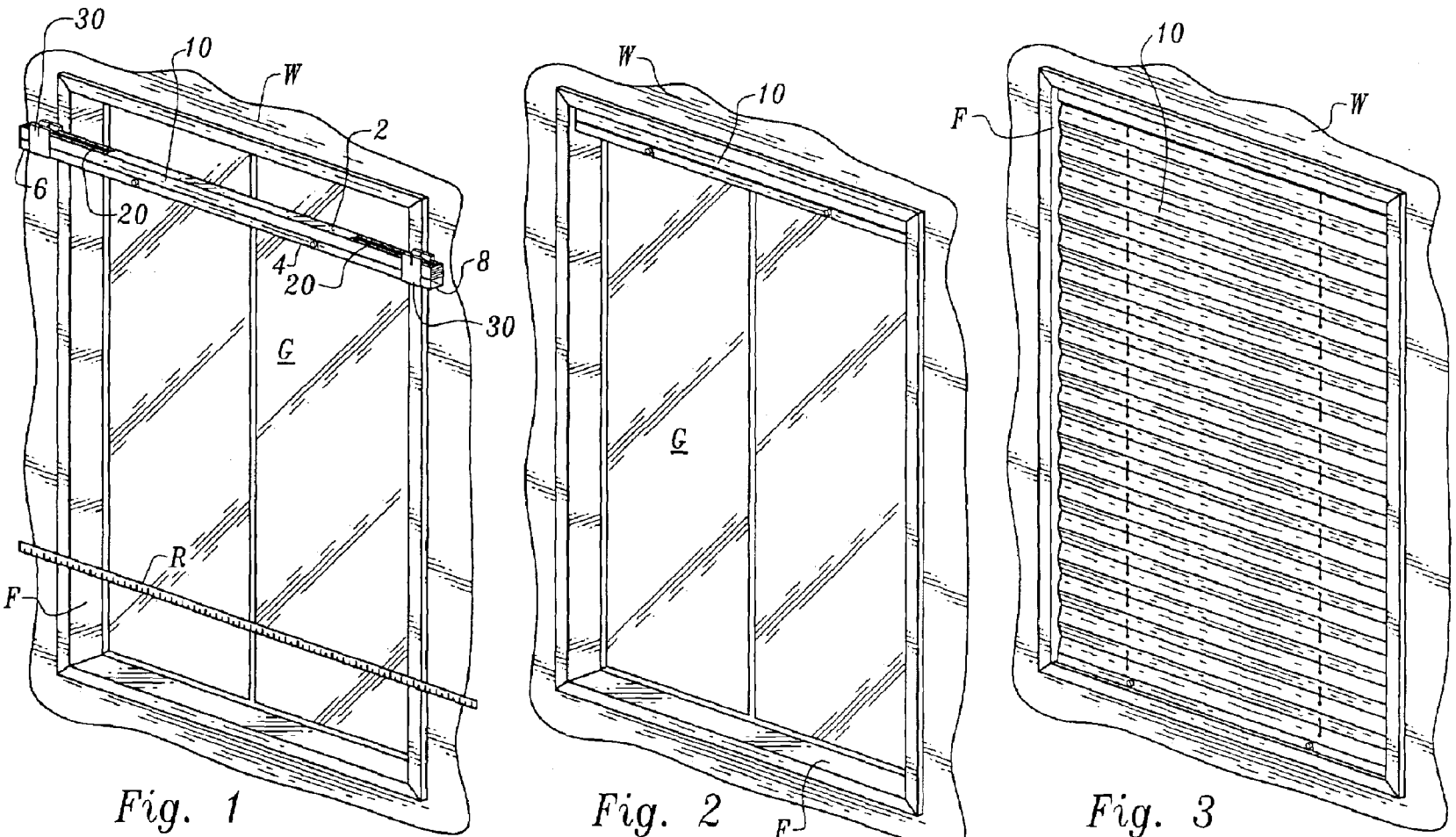
FIG. 1 is a perspective view of a rectangular window in the process of being measured along with a window shade shown before cutting thereof to fit within the window frame.
FIG. 2 is a perspective view similar to that of FIG. 1 but after completion of a cutting procedure and installation of the resized window shade within the window frame.
FIG. 3 is a perspective view similar to that of FIG. 2 but with the window shade deployed in a position covering the window.

Referring to the drawings, wherein like reference numerals represent like parts throughout the various drawing figures, reference numeral 10 (FIGS. 1–11) is directed to a window shade for use in at least partially occluding a space adjacent a window frame. The ruler strips 20 provide a preferred embodiment of a ruler adjacent the window shade 10 to assist in resizing of the window shade 10 to properly fit within the window frame F. A retainer can be utilized to hold the window shade during the cutting procedure (FIGS. 7–9) when the window shade 10 is resized. Reference numeral 110 is directed to an arched window shade assembly (FIG. 12) with a rule 140 (FIG. 13) which provides a variation on the ruler of this invention for properly resizing an arched window shade 120 to fit within an arched window frame above a sill S of an arched window.

Figure 4:
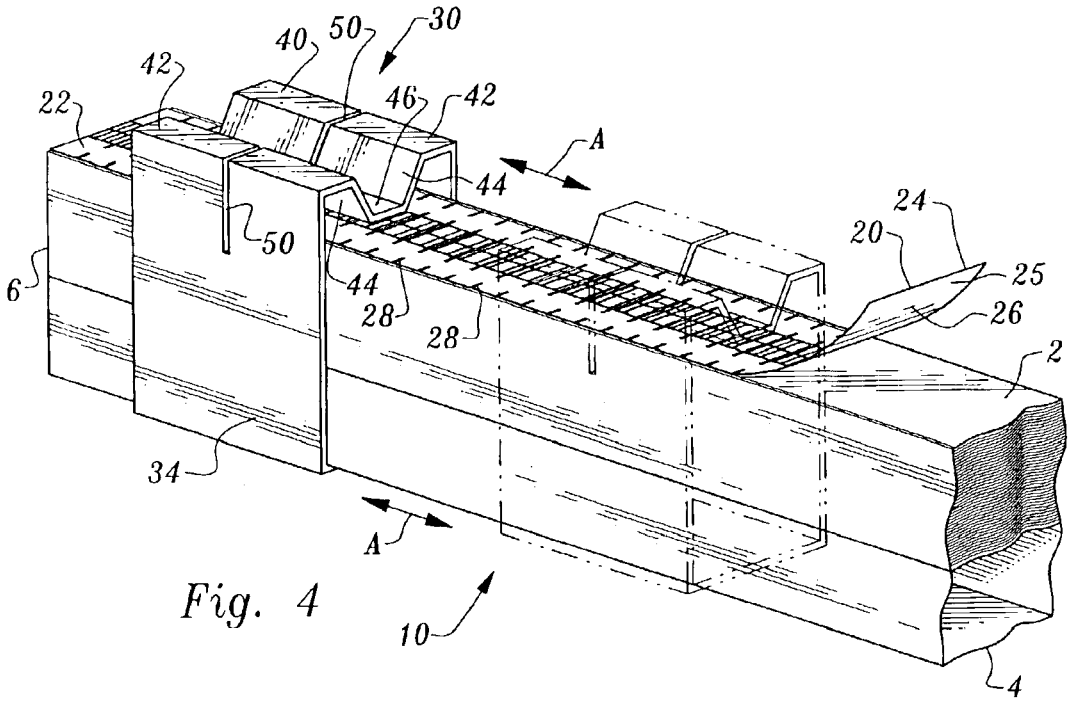
FIG. 4 is a perspective view of an end of the window shade before being cut and showing a ruler strip and retainer of this invention adjacent a left edge of the window shade.

In essence, and with particular reference to FIG. 4, the basic details of the preferred embodiment of the window shade with measurement guide of this invention are described. The window shade 10 can be any of a variety of different window shades of generally rectangular form (FIGS. 1–3) or arched form (FIG. 12). According to the preferred embodiment, at least one ruler strip 20 is provided adjacent an edge of the window shade 10. The ruler strip 20 can be attached to the window shade 10 or merely located adjacent the window shade 10 during measurement and cutting procedures associated with resizing the window shade 10 according to this invention. Graduations 28 and indicia 29 are located upon the ruler strip 20 (FIGS. 10 and 11) that do not accurately represent a width of the window shade 10, but rather represent a location on the window shade 10 where the window shade 10 should be cut when the window frame F (FIGS. 1–3) has a width matching the indicia 29. The indicia 29 are thus misdescriptive of the width of the window shade 10 and descriptive of the width of the window frame F.

Figure 7:
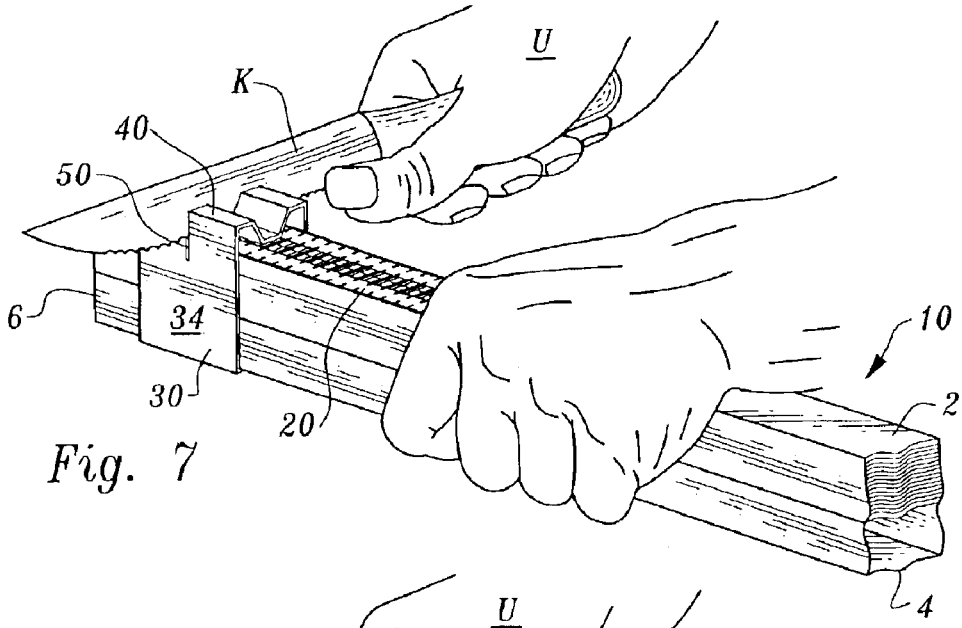
FIGS. 7–9 are perspective views of the left end of the window shade with the ruler strips and retainer included thereon, showing in sequence a cutting procedure for resizing the window shade according to this invention.
Figure 8:
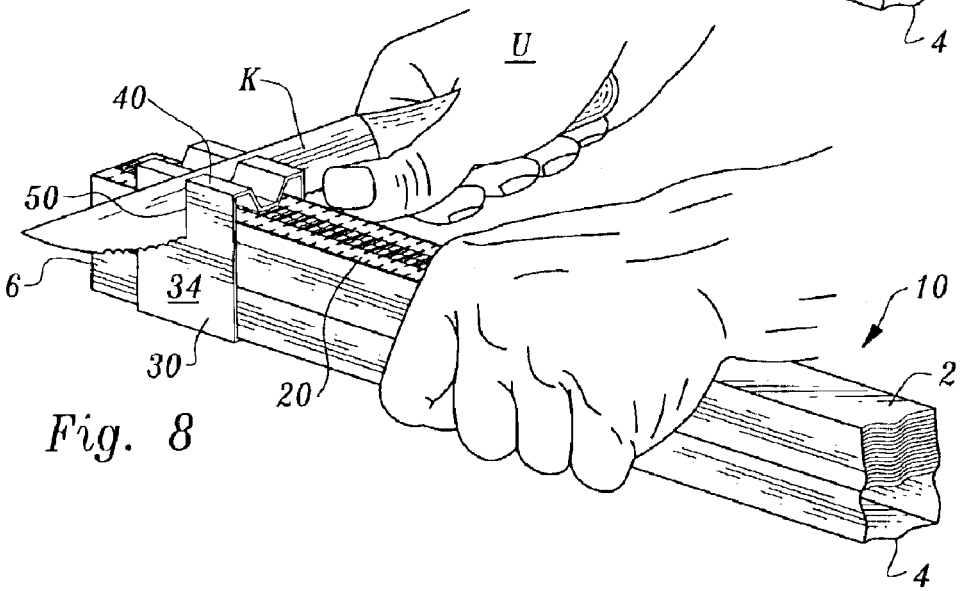
Figure 9:
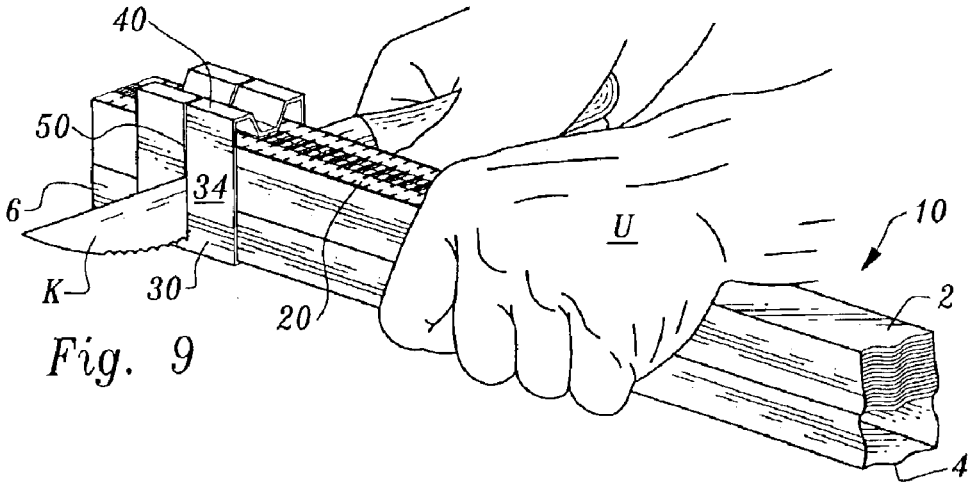

A retainer 30 is optionally provided which functions both to hold the window shade 10 in a collapsed form during cutting of the window shade 10 and also as a cutting guide to guide a cutting tool, such as a knife K (FIGS. 7–9), during this cutting process. A cap 40 in a retainer 30 allows a viewer to see through the cap 40 to view the indicia 29 and graduations 28 of the ruler strip 20 beneath the cap 40. A guide slot 50 in the retainer 30 extends vertically into the retainer 30 and assists in guidance of the knife K, or other cutting tool (FIGS. 7–9).

More specifically, and with particular reference to FIGS. 1–4, particular details of the window shade 10 are described. The window shade 10 can have any of a variety of different forms of generally rectangular shades or blinds configured to at least partially occlude the passage of light therethrough, particularly when the window shade 10 is located within a window frame F adjacent glass G of a window. For simplicity, window shades, window blinds and any other analogous window coverings are together generically referred to by the term "window shades."

The window shade 10 includes a top 2 parallel to a bottom 4. The bottom 4 typically extends a variable distance away from the top 2, such that the shade 10 is adjustable in height, but typically remains substantially parallel to the top 2. A left edge 6 and right edge 8 extend from the top 2 to the bottom 4. The edges 6, 8 are typically parallel to each other and spaced from each other by a width of the window shade 10. The width of the window shade 10 between the left edge 6 and right edge 8 is typically provided at a standard measurement at least as great as a largest width window frame F in which the window shade 10 is to be deployed.

Because windows G and their associated window frames F can vary greatly in size, the window shade 10 must in nearly all cases be custom cut to properly fit within the window frame F. It is desirable that the window shade 10 be similar to but actually slightly less than a width of the window frame F, to provide clearance along the left edge 6 and right edge 8 for proper deployment, height adjustment and symmetric positioning of the window shade 10.

Many window shades 10 include cords extending vertically therethrough. Some window shades 10 include visual markings thereon which are centered relative to a vertically extending center line of the window shade 10. In such instances, to maintain a symmetrical character of the window shade 10, it is necessary during resizing of the window shade 10 for equal amounts to be cut from both the left edge 6 and the right edge 8. When a window shade 10 does not include multiple symmetrically oriented vertically extending cords or other symmetrical patterns, or where an asymmetrical appearance is desired, it is acceptable to cut only the left edge 6 or the right edge 8 of the window shade 10. In such instances, a rule such as the rule 140, described in detail below with respect to the arched window variation of this invention, can be utilized on a rectangular window shade 10, as discussed in detail below.

The window shade 10 shown in FIGS. 1–11 is described in detail in U.S. patent application Ser. No. 10/194,193 incorporated herein by reference in its entirety. This window shade 10 as well as others often include significantly different internal structures including flexible and rigid portions, optionally cords, optionally pleats, optionally slats and other features. The measurement and sizing invention described herein is equally applicable to all such window shades, and is not merely limited to use with the window shade 10 described in detail herein and in the application incorporated herein by reference.

Figure 10:
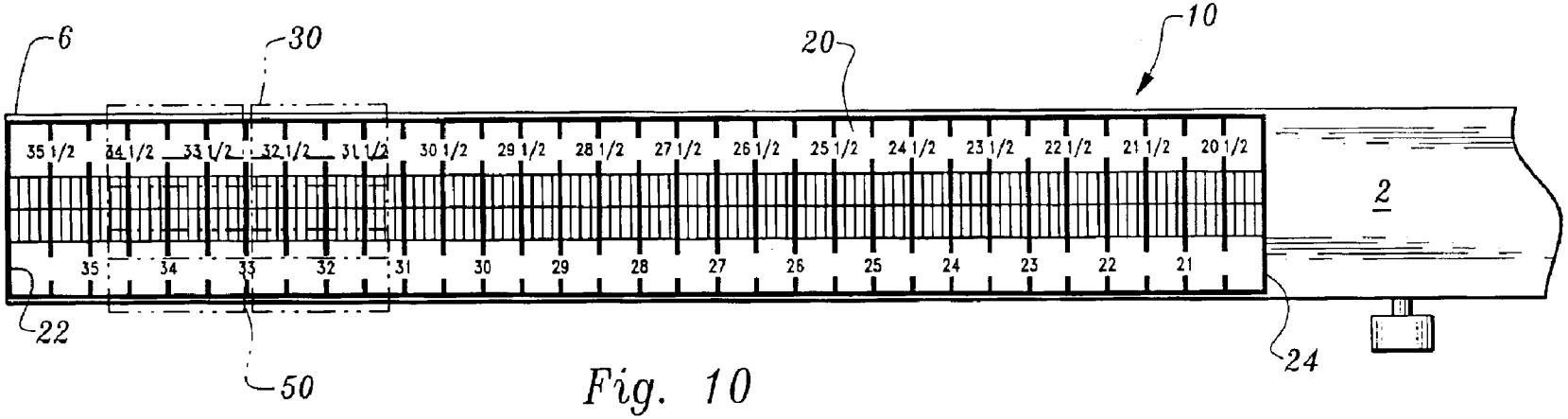
FIG. 10 is a top plan view of the left edge of the window shade of this invention with the ruler strip of this invention thereon and with the retainer of this invention shown in broken lines thereon.
Figure 11:
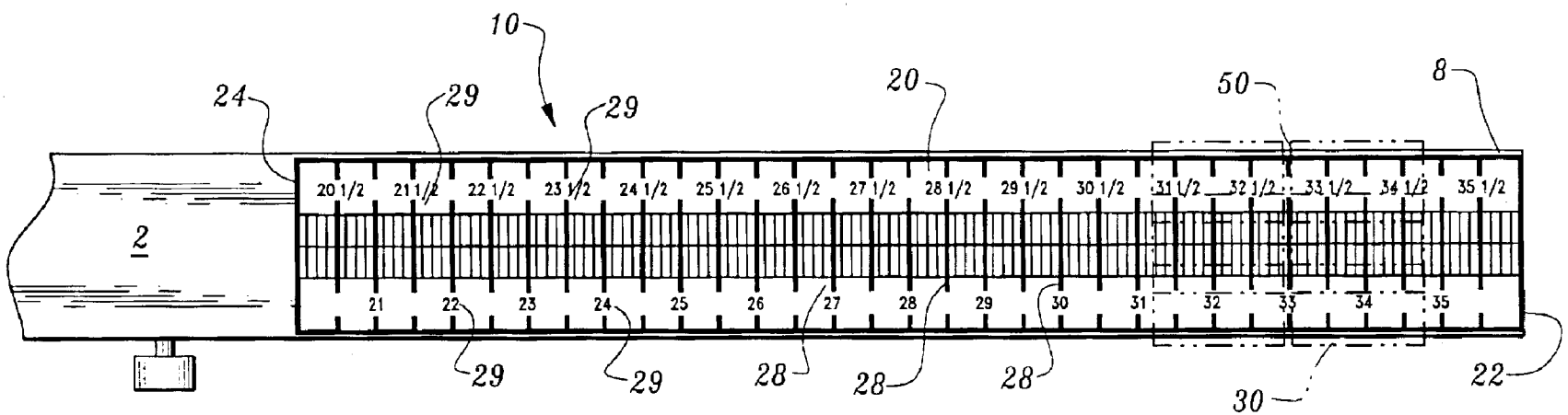
FIG. 11 is a top plan view of the right edge of a window shade including a second ruler strip thereon which is a mirror image of the ruler strip of FIG. 10 and showing the retainer of this invention in broken lines thereon.

With particular reference to FIGS. 4, 10 and 11, details of the ruler strips 20 of this invention are described. The ruler strips 20 provide a preferred form of rule or ruler for accurately determining where the shade 10 should be cut. The ruler strips 20 of this invention are preferably provided in a set of two including a left ruler strip 20 and a right ruler strip 20 which are mirror images of each other (FIGS. 10 and 11). Hence, each graduation 28 on the left ruler strip 20 has a corresponding graduation 28 on the right ruler strip 20. Alternatively, the pair of ruler strips 20 can be identical and not mirror images of each other, in which case when viewing the left edge 6 and right edge 8 of the window shade 10 with the ruler strip 20 adjacent thereto, one of the ruler strips 20 would appear right side up and the other ruler strip would appear upside down. Also, it is conceivable that a single ruler strip could be provided which would extend from the left edge 6 to the right edge 8. Middle portions of such a single ruler would be left blank or could include graduations 28 and indicia 29.

The ruler strips 20 can be attached, engraved, embossed, printed or otherwise formed into the window shade 10, such as to the top 2 of the window shade 10, in a permanent or removable fashion, or the ruler strips 20 can be provided upon a separate rigid or flexible structure which is merely placed adjacent the window shade 10 during measurement and cutting, but is never actually attached to the window shade 10.

In a preferred embodiment, the ruler strips 20 are attached to the top 2 of the window shade 10, and optionally to also the bottom 4 of the window shade 10. In this way, any error associated with improperly locating the ruler strips 20 adjacent the left edge 6 and right edge 8 can be avoided. Alternatively, the ruler strips 20 could be on a separate rigid or flexible structure, such as a yardstick type device or a measuring tape type device for placement next to the window shade 10.

Each ruler strip 20 includes an outer edge 22 preferably to be placed adjacent the left edge 6 or right edge 8 of the window shade 10. An inner edge 24 opposite the outer edge 22 is closer to a middle of the window shade 10.

Each ruler strip 20 includes an underside 25 (FIG. 4) which is preferably formed of a waxy material or is otherwise coated so that it can loosely adhere to an adhesive 26 upon either the underside 25 or the top 2 of the window shade 10. In this preferred configuration, the ruler strip 20 can be lifted easily off of the top 2 with the underside 25 releasing the adhesive 26 and leaving the adhesive 26 upon the top 2 of the window shade 10. In this way, the ruler strip 20 is removed from the top 2 of the window shade 10 after use to resize the shade 10 and the adhesive 26 is exposed for use in attaching the top 2 of the window shade 10 to an upper portion of the window frame F for deployment of the window shade 10 (FIGS. 2 and 3).

Alternatively, the adhesive 26 can be placed on an upper surface of the ruler strips 20 with a clear backing strip placed over the adhesive 26 or restricted to only portions of the upper surface, such as down a middle region of the ruler strips 20 so that the graduations 28 and indicia 29 can still be viewed when located alongside the middle region.

The ruler strips 20 present graduations 28 and indicia 29 on an upper side of the ruler strips 20. These graduations 28 and indicia 29 are visually perceptible markings to assist a user in properly cutting the window shade 10 while it is adjacent to the ruler strips 20.

Particularly, each of the graduations 28 is preferably a linear line extending perpendicular to a long axis of the window shade 10. Preferably, multiple graduations 28 are provided upon the ruler strip 20 with each graduation 28 spaced a similar distance away from adjacent graduations. The graduations 28 need not extend entirely across the ruler strips 20, but need only extend sufficiently long to clearly identify the line upon which the window shade 10 might potentially be cut. It is also conceivable that the graduations 28 could be in the form of mere dots or points along the ruler strip 20 and still function according to this invention. The graduations 28 could also be other visually perceptible markings, such as merely a transition between regions of different color or shading, or other markings appropriate to identify points at which the window shade 10 could be cut.

The indicia 29 are arranged so that each indicium 29 is associated with a graduation 28. It is not strictly necessary that every graduation 28 include an indicium 29. Rather, only at least some of the graduations 28 need include indicia 29. The indicia 29 are representative of measurements, preferably in the form of numbers representative of lengths, such as inches or centimeters. The indicia 29 can additionally include lettering (i.e. "in." or "cm") to represent what type of measurement is represented by the indicia 29.

Preferably, the indicia 29 are misdescriptive of the position of the graduations 28 in at least two respects. First, the indicia 29 are adjacent graduations which are twice as close to each other as the graduations would typically be on a standard ruler. For instance, the indicia "25" would be adjacent a graduation 28 which is only one half inch (on a ruler strip 20 provided in inches) away from a graduation having the indicia "24" adjacent thereto. This misdescriptiveness of the indicia 29 simplifies the use of the ruler strips 20 in that the indicia 29 do not represent width of the window shade 10, but rather represent a width of the window frame F into which the window shade 10 will properly fit when cut at the graduation adjacent the indicia selected.

Because it is desirable to cut half of an excess portion of the window shade 10 away from each of the edges 6, 8 of the window shade 10, the graduations 28 are twice as close as they would otherwise be to appropriately compensate. As a result, a user need not calculate where the window shade 10 must be cut, but merely need measure the window frame F and then cut the window shade 10 at the graduation adjacent the indicia which corresponds with the width of the window frame F.

Secondly, the ruler strips 20 are located so that the graduations 28 have indicia 29 adjacent thereto which are similar to but do not exactly represent a distance to the corresponding graduation on the other ruler strip 20 at the other edge of the window shade 10. For instance, the indicia "30" on the left ruler strip 20 adjacent the left edge 6 might be 29.5 inches away from an indicia "30" on the right ruler strip 20 adjacent the right edge 8 of the window shade 10. This half inch (for example) discrepancy provides a half inch of clearance (one quarter inch at each edge 6, 8) between edges 6, 8 of the window shade 10 and the vertical sides of the window frame F. Hence, the graduations 28 and indicia 29 are not descriptive of the width of the window shade 10, but rather descriptive of the width of the window frame F into which the window shade 10 can properly fit with desired clearance when cut at the graduation adjacent the indicia representative of the width of the window frame F.

Figure 5:
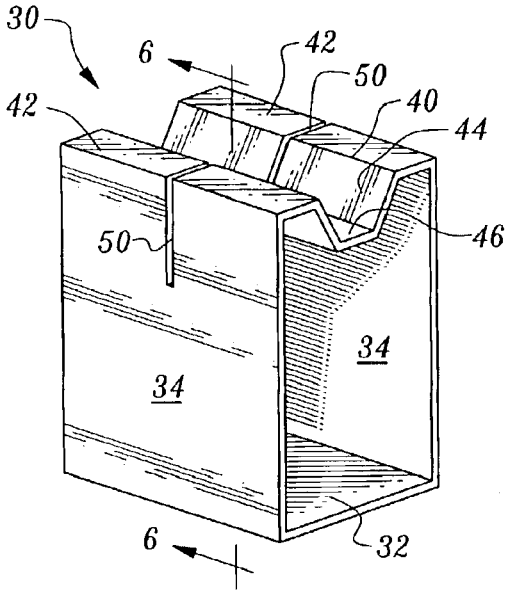
FIG. 5 is a perspective view of the retainer of this invention shown alone.
Figure 6:
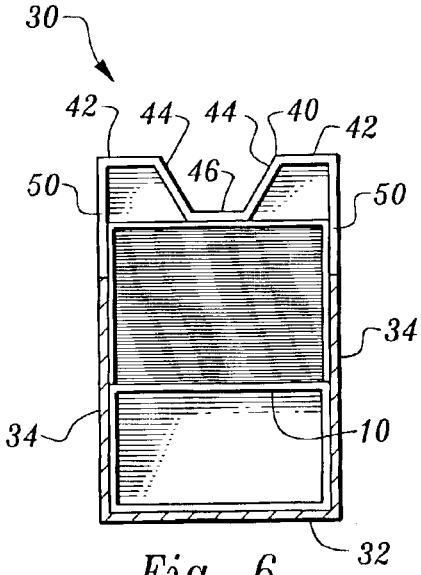
FIG. 6 is a full sectional view taken along line 6—6 of FIG. 5 and showing both the retainer and the window shade in full section.

With particular reference to FIGS. 4–6, details of the retainer 30 are described. The retainer 30 is optionally provided first to hold the window shade in its collapsed form during shipping and storage of the window shade 10, and later to assist in the proper positioning of a cutting tool such as a knife K (FIGS. 7–9) in cutting the window shade 10 where desired. The retainer 30 essentially acts as a collar with a central gap sized just large enough to allow the collapsed window shade 10 to fit within the central gap.

The retainer 30 includes a floor 32 which is preferably substantially planar with a pair of side walls 34 extending perpendicularly up from edges of the floor 32. A cap 40 joins upper edges of the side walls 34 together. The cap 40 preferably includes upper facets 42 which extend horizontally toward each other. Angled facets 44 extend down from edges of the upper facets 42 down to a lower facet 46 which extends horizontally to join the angled facets 44 together. The lower facet 46 is parallel with the upper facets 42 but lower than the upper facets 42. This configuration of the cap 40 is preferred, but is only one form of cap 40 for use in surrounding the central gap of the retainer 30. It is also conceivable that the retainer 30 could be in the form of a vice having a cross-section similar to a letter "C."

A guide slot 50 preferably extends through the cap 40 and partially through the side walls 34. The guide slot 50 preferably extends in a vertical plane perpendicular to a long axis of the window shade 10 when the window shade is passing through the central gap of the retainer 30. The retainer 30 is preferably formed of a material which is rigid but exhibits similar cutability characteristics to the materials from which the window shade 10 is formed. In this way, a cutting tool such as a knife K can initially cut the window shade 10 while the knife K or other cutting tool is located within the guide slot 50. When a bottom of the guide slot 50 has been reached, the cutting tool can continue to cut both the window shade 10 and the retainer 30, in effect deepening the slot. When the cutting tool reaches the floor 32 of the retainer 30 (FIG. 9) the window shade has been completely cut but the retainer 30 is still holding portions of the window shade 10 adjacent the cutting tool securely together. In this way, a very clean edge 6, 8 can be provided for the window shade 10.

Preferably, the cap 40 is formed in at least some locations with at least partially transparent material so that the indicia 29 and graduations 28 can be viewed through the cap 40. Alternatively, openings can be provided within the cap 40 at positions required so that the indicia 29 can be viewed. For instance, the guide slot 50 can have wide spots therein having a size at least as large as the indicia 29 and spaced from the side walls 34 of the retainer 30 similar to a spacing that the indicia 29 exhibit away from the sides of the window shade 10. These openings in the guide slot 50 would allow the indicia 29 to be viewed therethrough when the retainer 30 is positioned (along arrow A of FIG. 4) at the position desired. When the proper indicia 29 shows through this opening in the guide slot 50, the graduation 28 would be aligned with the guide slot 50 for the cutting procedure (FIGS. 7–9).

In use and operation, and with particular reference to FIGS. 1–4 and 7–9, the window shade 10 is measured and resized in the following manner utilizing the ruler strips 20, and retainer 30 according to a preferred embodiment of this invention. Initially, the window shade 10 is provided with the top 2 including left and right ruler strips 20 thereon adjacent the left edge 6 and right edge 8 of the window shade 10. The ruler strips 20 are preferably attached to the top 2 of the window shade 10 in a removable fashion with an adhesive 26 beneath the ruler strips 20.

A user U next measures a width of the window frame F (FIG. 1). A stretched ruler R (i.e. a yardstick) can be utilized or other measuring tool to measure the width of the window frame F. If the window frame F has a non-rectangular or other variable form, it may be desirable to take multiple measurements of the width of the window frame F with the narrowest width of the window frame F being identified. This width for the window frame F is remembered or noted by the user U for use throughout the process of cutting the window shade 10 according to this invention.

Next, the user U slides the retainer 30 (along arrow A of FIG. 4) until the graduation 28 is adjacent the guide slot 50 of the retainer 30 which has the indicium 29 adjacent thereto which matches the width of the window frame F. The user U utilizes a knife K or other cutting tool (FIGS. 7–9) to cut the window shade 10 at the graduation 28 or at a location between graduations that correspond with a measurement of the window frame F.

Specifically, the knife K is placed within the guide slot 50 and is used to cut down through the window shade 10. When the bottom of the guide slot 50 has been reached by the knife K or other cutting tool, the knife K continues to cut both the window shade 10 and the remainder of the retainer 30 until the knife K or other cutting tool has reached the floor 32 of the retainer 30.

The user U then repeats this procedure with a second retainer 30 at the right edge 8 of the window shade 10. The same indicium 29 is utilized in cutting the right edge 8 of the window shade 10 as is utilized in cutting the left edge 6 of the window shade 10.

Finally, the ruler strips 20 can be pealed away from the top 2 of the window shade 10 so that the adhesive 26 is available for holding the top 2 of the window shade 10 adjacent the window frame F in front of the window G. The window shade 10 will have a width which is slightly less than a width of the window frame F with an appropriate amount of clearance adjacent sides of the window shade 10 and with the window shade 10 exhibiting a symmetrical appearance, having had a similar amount cut from either edge of the window shade 10.

In a variation on the above described method of operation of this invention, it is not strictly required that the retainer 30 be utilized. Rather, the user U can merely identify the graduation 28 having the indicium 29 adjacent thereto which matches the width of the window frame F and then utilize a cutting tool, such as a knife K or any other form of cutting tool, to cut the window shade 10 adjacent the graduation 28.

In forming the ruler strips 20, the following formulas can be utilized in calculating the proper location of the graduations 28 and indicia 29 relative to the outer edge 22 and inner edge 24 of the ruler strips 20 and relative to each other at the left and right edges 6, 8 of the window shade 10.

Where z=original shade width;
w=width of shade when cut at x;
x=indicia and width of window frame;
c=clearance at each side of shade;
d=actual distance from adjacent edge of shade to indicia x, also amount to be removed;

The following equations show relative relationships:

$$x=x-2(c) \quad \text{(Equation 1)}$$

$$c=\tfrac{1}{2}(z-w) \quad \text{(Equation 2)}$$

$$c=\tfrac{1}{2}(z-(x-2c)) \quad \text{(Equation 3).}$$

Illustrating this relationship with an example;
if z=35.5
and c=0.25
and x=30 (w=29.5)
d=3.0.

Hence, three units would be removed from each edge of the shade 10.

With particular reference to FIGS. 12–14, basic details of an arched window variation of this invention are described. When an arched window is to have an arched shade 120 adjacent thereto, an arched window shade assembly 110 including an arched shade 120 and a retainer 150 can be utilized. Such an assembly 110 is particularly described in U.S. patent application Ser. No. 10/318,975 incorporated herein by reference.

Uniquely, such an arched window shade assembly 110 starts with a generally rectangular form but then is expanded in a fanned fashion so that a second end 122 is colinear with the first end 124, in the case of a half circle arched shade 120 (other degrees of angular displacement are possible). An inside edge 126 and outside edge 128 maintain a constant distance from each other, but the inside edge 126 is essentially maintained near a central point with the outside edge 128 extending along a perimeter of the arched shade 120. A retainer 150 is provided to hold the arched shade 120 in this fanned form adjacent the arched window, with the retainer 150 resting upon a sill S beneath a curved ceiling C forming the window frame adjacent the arched window. The retainer 150 can include a base 152 to help support the inside edge 126.

Even if no retainer 150 or base 152 is utilized, the inside edge 126 does not precisely reside at a single point, but rather exhibits a small arch with a small space adjacent thereto. Also, it is desirable with an arched window shade 120 that some clearance be provided adjacent the curved ceiling C. For this reason, a measuring and cutting system akin to that of the preferred embodiment of this invention is utilized which is in fact misdescriptive of a width of the arched shade 120, but rather is descriptive of a height of the arched window adjacent to which the arched shade 120 is to be placed.

With particular reference to FIG. 13, details of the rule 140 on the shade 120 are described which allow the shade 120 to be properly sized according to this invention. The rule 140 includes a series of graduations 142 (i.e. lines or other generally linear markings) extending along at least a portion of the thickness of the shade 120, preferably adjacent both the first end 124 and second end 122. Indicia 144, preferably in the form of numbers, are provided adjacent at least some of the graduations 142 to identify the graduations 142. Preferably, a rule 140 is provided on both the first end 124 and the second end 122. While the rule 140 can be identical on both the first end 124 and second end 122, preferably English units of measurement are provided on the rule 140 on the first end 124 and metric units of measurement are provided on the rule 140 on a second end 122. Such a dual system could similarly be used with the preferred embodiment of this invention.

Uniquely, the graduations 141 and indicia 144 of the rule 140 are distorted slightly from a true measurement of a width of the shade 120 from the inside edge 126 to the outside edge 128. Specifically, the rule 140 is shifted a slight amount toward the inside edge 126. This slight amount matches a radius of the hump 160 within the retainer 150, described in detail below. Because the hump 160 causes the inside edge 126 of the shade 120 to be slightly raised above the sill S, the user avoids the complexity of subtracting out the height of the hump 160 when properly measuring and cutting the shade 120.

For instance, if the hump 160 has a radius of a half inch, the rule 140 is provided with the graduations 142 and corresponding indicia 144 shifted one half inch toward the inside edge 126. Hence, by way of example, the number "120" would be an indicia 144 adjacent a graduation 142 which would in actuality be 19.5 inches away from the inside edge 126 of the shade 120. When a user cuts the shade 120 at the graduation 142 adjacent the "120" indicia 144 the shade 120 will have been cut to have a width between the inside edge 126 and the outside edge 128 which is 19.5 inches. When the shade 120 is later deployed adjacent the retainer 150, the hump 160 will raise the shade 120 by a half inch so that the shade will actually have a height of 20 inches above the sill. Preferably, the rule 140 is also shifted additionally slightly (i.e. one fourth of an inch) to accommodate thickness of the base 152 of the retainer 150 and to provide a margin of clearance for the shade 120. Hence, a user merely measures a height of the window and then cuts the shade 120 at the indicia 144 which matches the measurement made of the window height.

Preferably, either a portion or all of the rule 140 is provided upon a backing strip 148 which protects an adhesive 146 on the first end 124 and second end 122. Hence, after the shade 120 has been cut, the backing strip 148 can be removed to expose adhesive 146 underneath for securing the ends 122, 124 to a base 152 of the retainer 150 and to the sill S. In this way, the shade 120 is securely held to the retainer 150 and to the sill S when deployed. Other fasteners could similarly be utilized including tacks or other mechanical fasteners or a user could provide a separate adhesive, such as glue or paste, or utilize adhesive tape, or any other fastening means.

The rule 140 can be used on a rectangular window shade 120 (FIGS. 1–3) in situations where maintenance of a symmetrical nature of the shade 120 is not required or not affected by removal of material from only one edge of the shade 120.

This disclosure is provided to reveal a preferred embodiment of the invention and a best mode for practicing the invention. Having thus described the invention in this way, it should be apparent that various different modifications can be made to the preferred embodiment without departing from the scope and spirit of this disclosure. When structures are identified as a means to perform a function, the identification is intended to include all structures which can perform the function specified. When structures of this invention are identified as being coupled together, such language should be interpreted broadly to include the structures being coupled directly together or coupled together through intervening structures. Such coupling could be permanent or temporary and either in a rigid fashion or in a fashion which allows pivoting, sliding or other relative motion while still providing some form of attachment. When structures of this invention are identified as being adjacent each other, such positioning could include actual contact, fastening together or merely placement near each other without significant intervening structures. When items of this invention are referred to in the singular, the possibility of more than one other similar or dissimilar such item is not foreclosed.

What is claimed is:

1. A method for sizing a width of a window shade between edges thereof, such as to allow the window shade to fit within a window frame surrounding a window, the steps including:

providing a plurality of visible graduations adapted to be placed adjacent to the window shade, each graduation spaced a different distance away from edges of a window shade to be cut when the graduations are placed adjacent to the window shade;

attaching the plurality of visible graduations to the window shade;

placing a plurality of visible indicia, with each indicium adjacent one of the graduations;

measuring a width of the window frame;

identifying at least one indicium corresponding with the width of the window frame from said measuring step; and cutting the window shade near at least one graduation adjacent the indicium indicated in said identifying step.

2. The method of claim 1 wherein said placing step includes the step of having each indicium misdescriptive of a width which the window shade would exhibit if the window shade were cut at the graduation adjacent said indicium including the further step of spacing at least one of the graduations from edges of the window shade a distance different than a distance represented by the indicium adjacent the at least one graduation.

3. The method of claim 2 wherein an amount of the misdescriptiveness includes a clearance amount between edges of the shade and sides of a frame adjacent the window.

4. The method of claim 1 including the further step of cutting each edge of the window shade at a graduation adjacent a similar indicium representative of a width of the window frame.

5. The method of claim 4 wherein said cutting step includes the step of cutting a similar amount from both a left edge and a right edge of the window shade.

6. The method of claim 1 including the further of positioning said plurality of visible graduations upon a flexible strip of material, and attaching the flexible strip of material to at least one elongate surface of the window shade.

7. The method of claim 6 including the further step of configuring the flexible strip of material to include means to be removably attached to the window shade.

8. The method of claim 7 including the further step of providing an adhesive between the flexible strip of material and the shade, the flexible strip of material and adhesive selected from compositions which allow the adhesive to remain attached to the shade when the flexible strip of material is removed from the shade, with the adhesive having sufficient strength to support a weight of the shade suspended below a horizontal surface through the adhesive.

9. The method of claim 8 including the further step of attaching the flexible strip of material to at least one end of an arched window shade with the graduations on the flexible strip of material having indicia adjacent thereto representative of a combination of both a width of the arched window shade before expansion into a fanned configuration when cut at the graduation adjacent the indicia, plus a clearance amount adjacent an outside edge of the arched window shade and a clearance amount adjacent an inside edge of the arched window shade.

10. The method of claim 8 including the further step of attaching the flexible strip of material to a rectangular window shade with graduations on the flexible strip of material having indicia adjacent thereto representative of a combination of both a width of the shade when cut at the graduation adjacent the indicia plus an amount of clearance adjacent left and right edges of the window shade when the window shade is cut at the graduation adjacent the indicia.

11. The method of claim 1 including the further steps of placing a retainer adjacent the window shade and cutting the window shade through the retainer.

12. The method of claim 11 including the further step of providing a slit within the retainer and guiding a cutting tool within the slit of the retainer during said cutting steps.

13. The method of claim 1 including the further step of locating the graduations where required on the shade to allow the shade to be cut to a length approximately corresponding with the indicia.

14. A kit for covering a window with a shade matching a size of the window, the kit including:

a window shade having a top spaced from a bottom and side edges located a substantially constant distance from each other defining a width of said shade;

a plurality of visible graduations attached to at least one elongate surface of said shade, each graduation adapted to be spaced a different distance away from edges of a window shade to be cut when said graduations are placed adjacent said shade;

at least one visible indicium located adjacent one of said graduations, said indicium misdescriptive of a width which the window shade would exhibit if the window shade were cut at a location adjacent said graduation adjacent said indicium.

15. The kit of claim 14 further including said shade being collapsible and said kit having a retainer having a central gap with a height similar to a height of said shade when said top is closest to said bottom due to collapse of said shade, said retainer removably located with said central gap supporting said window shade within said central gap.

16. The kit of claim 15 wherein said retainer includes a slit in at least a portion thereof, said slit oriented in a vertical plane substantially perpendicular to a long axis of said window shade.

17. The kit of claim 15 wherein said retainer includes a cap adapted to be located adjacent said top of said window shade, said cap defining an upper portion of said retainer overlying said central gap of said retainer.

18. The kit of claim 17 wherein said cap is at least partially clear to allow said indicia to be viewed through said cap.

19. The kit of claim 17 wherein said cap has at least one opening therein sufficiently large to allow said indicia to be viewed through said at least one opening.

20. The kit of claim 14 wherein said shade is rectangular in form with parallel side edges.

21. The kit of claim 14 wherein said window shade is arched in form having a fanned configuration with an inside edge maintaining a constant distance away from an outside edge and with said outside edge curving.

22. The kit of claim 21 wherein an amount of said indicium misdescriptiveness includes a clearance amount between said side edges of the window shade and a frame surrounding a window with which the shade is adapted to be placed.

23. The kit of claim 14 wherein said plurality of visible graduations are located upon a flexible strip of material.

24. The kit of claim 23 wherein said flexible strip of material is adapted to be attached to at least one elongate surface of said shade.

25. The kit of claim 23 wherein said flexible strip of material includes means to be removably attached to said shade.

26. The kit of claim 25 wherein an adhesive is provided between said flexible strip of material and said shade, said flexible strip of material and said adhesive selected from compositions which allow said adhesive to remain attached to said shade when said flexible strip of material is removed from said shade, with said adhesive having sufficient strength to support a weight of said shade suspended below a horizontal surface through said adhesive.

27. The kit of claim 14 wherein said graduations are printed upon said shade.

28. A measuring device for measuring a window shade before cutting the window shade, the device comprising in combination:

at least one ruler, said at least one ruler adapted to be placed adjacent a window shade to be measured;

a plurality of visible graduations upon said at least one ruler, at least one of said graduations having a corresponding graduation adapted to be spaced from a first edge of the window shade a similar distance that said at least one graduation is spaced from a second edge of the window shade when said at least one ruler is located adjacent the window shade, such that cutting the shade at said at least one graduation and at said corresponding graduation will result in removal of a similar amount from the first edge of the window shade and the second edge of the window shade; and wherein said at least one indicium is representative of a measurement that is equal to a sum of both a width of the window shade when the window shade is cut at said at least one graduation and said corresponding graduation, plus a clearance amount, such that after being cut the shade is smaller than the measurement represented by said indicium and can fit within a window frame adjacent a window and exhibit clearance between edges of the shade and the window frame.

29. The device of claim 28 further including at least one indicium adjacent said at least one graduation, said indicium representative of a measurement that is at least as large as a width of the window shade when the window shade is cut adjacent said at least one graduation and the window shade is cut adjacent said corresponding graduation.

30. The device of claim 29 wherein a second indicium similar to said at least one indicium is located adjacent said corresponding graduation.

31. The device of claim 28 further including at least two indicia, each of said indicia closer to the first edge of the window shade than the second edge of the window shade when said ruler is located adjacent the window shade, said at least two indicia located adjacent separate graduations, said at least two indicia representative of different measurements, a difference between measurements represented by the indicia equal to double a distance between said graduations adjacent said at least two indicia.

32. The device of claim 28 wherein said at least one ruler is adapted to be attached to the window shade.

33. The device of claim 28 wherein said at least one ruler is a separate structure adapted to be selectively locatable at multiple different positions relative to the window shade.

34. The device of claim 28 wherein each of said plurality of visible graduations are located upon a common ruler with portions of said ruler closer to the first edge of the window shade and portions of said ruler located closer to the second edge of the window shade when the ruler is located adjacent the window shade.

35. The device of claim 28 wherein said at least one ruler includes at least two rulers with one of said two rulers adapted to be located adjacent the first edge of the window shade and the other of said at least two rulers adapted to be located adjacent the second edge of the window shade, said at least one graduation located on one of said at least two rulers and said corresponding graduation located on the other of said at least two rulers.

36. A measuring system for measuring a window shade before cutting the window shade, the system comprising in combination:

a window shade having a left edge and right edge;

a ruler attached to said window shade;

said ruler including at least one graduation thereon;

said ruler including at least one indicium thereon, said at least one indicium adjacent said at least one graduation; and said indicium misdescriptive of a width of said shade after said shade is cut at said at least one graduation adjacent said at least one indicium.

37. The system of claim 36 wherein a difference between a measurement represented by said indicium and a width of said shade after said shade is cut at said at least one graduation adjacent said at least one indicium includes a clearance amount by which said shade is adapted frame adjacent a window with clearance between the window frame and said edges of said window shade.

38. The system of claim 36 wherein said ruler is positioned relative to said window shade with said at least one graduation spaced from one of said edges of said window shade by a distance less than a distance indicated by said at least one indicium adjacent said at least one graduation.

39. The system of claim wherein said window shade is substantially rectangular with a top and a bottom extending between said left edge and said right edge and with said left edge and said right edge oriented parallel to each other.

40. The system of claim 36 wherein said window shade is arched with said left edge maintaining a constant distance away from said right edge, and with one of said edges exhibiting a curving form and the other of said edges adjacent a central point about which said window shade is arched.

41. The system of claim 36 wherein said indicium is approximately representative of a width measurement that the window shade will exhibit after the window shade is cut at said graduation adjacent said indicium.

42. The system of claim 36 wherein said indicium is approximately representative of a width measurement that the window shade will exhibit after the window shade is cut both at said graduation adjacent said indicium and cut at a second location severing a similar amount from said window shade.

* * * * *